US005247818A

United States Patent [19]

Lo

[11] Patent Number: 5,247,818

[45] Date of Patent: Sep. 28, 1993

[54] CYLINDER LOCK

[76] Inventor: Jian P. Lo, 2 Fl. 7 Lane 62 Ho Kong Street, Shi Lin District, Taipei, Taiwan

[21] Appl. No.: 859,202

[22] Filed: Mar. 27, 1992

[51] Int. Cl.[5] ..... E05B 27/10

[52] U.S. Cl. ..... 70/493; 70/378; 70/403; 70/409

[58] Field of Search ..... 70/493, 403, 404, 378, 70/402, 405, 406, 407, 409

[56] References Cited

U.S. PATENT DOCUMENTS

| | | | |
|---|---|---|---|
| 18,169 | 9/1857 | Yale | 70/403 |
| Re. 26,272 | 9/1967 | Schreiber et al. | 70/493 |
| 31,278 | 1/1861 | Yale, Jr. | 70/403 |
| 183,047 | 10/1876 | Essex | 70/403 |
| 913,942 | 3/1909 | Bodge | 70/405 |
| 1,514,318 | 11/1924 | Henriksson | 70/409 |
| 1,635,724 | 7/1927 | Morris | 70/409 |
| 2,093,925 | 9/1937 | Pickop | 70/493 |
| 2,439,099 | 4/1948 | Ressetar | 70/493 |
| 3,637,180 | 1/1972 | Pa Rry | 70/403 |
| 3,681,953 | 8/1972 | Luttrall | 70/405 |
| 3,780,549 | 12/1973 | Schlage | 70/404 |
| 4,193,277 | 3/1980 | Lo | 70/493 |
| 4,289,002 | 9/1981 | Gretler | 70/493 |

FOREIGN PATENT DOCUMENTS

| | | | |
|---|---|---|---|
| 0993427 | 10/1951 | France | 70/493 |
| 419023 | 1/1948 | Italy | 70/493 |

*Primary Examiner*—Peter M. Cuomo
*Assistant Examiner*—Darnell M. Boucher
*Attorney, Agent, or Firm*—Lowe, Price, LeBlanc & Becker

[57] ABSTRACT

A cylinder lock having a barrel and a cylinder and being actuable by a key having a round shaft. The round shaft has provided along its one longitudinally extending planar surface a plurality of substantially rectangular recesses which correspond with pin portions of lower tumblers normally extending into the keyhole of the cylinder and biased by springs and upper tumblers in the barrel, such that when the key is inserted into the keyhole and rotated to a predetermined position to allow the pin portions to be received in the corresponding recesses, the cylinder can be driven to rotate relative to the barrel by the turning force of the key transmitted to the pin portions through their contact with the side walls of the recesses if the key is further rotated, thereby locking or unlocking the cylinder lock.

12 Claims, 4 Drawing Sheets

CYLINDER LOCK

FIELD OF THE INVENTION

This invention relates to a cylinder lock, particularly to an improvement in a cylinder lock and the tumblers thereof.

BACKGROUND OF THE INVENTION

A cylinder lock actuable by a round key shaft is conventionally provided with a key engaging means at the inner end of its cylinder to engage with a notch formed at the end of the key shaft such that the cylinder can be caused to turn to lock or unlock the lock device when the key is rotated. With such a construction, the key's use may be inconvenient, especially in a dim or dark place, as the user has to insert the key into the keyhole at a predetermined orientation to cause the aforementioned operations to succeed.

Furthermore, although the security of a cylinder lock can be increased by adding a number of tumbler assemblies, it increases the size, cost and complexity of the lock, thus making the same not commercially economical.

In view of the aforesaid drawbacks, one object of this invention is to provide a cylinder lock without a key engaging means which can be actuated by a round key shaft axially inserted into the keyhole at a random orientation.

Another object of this invention is to provide a cylinder lock which is simple in construction, but still pick-resistant.

SUMMARY OF THE INVENTION

According to this invention, the cylinder lock has a stationary barrel, a cylinder rotatably mounted in the barrel, and tumbler assemblies each including a spring and a pair of upper and lower tumblers mounted in radial bores in the barrel and cylinder. The key for actuating the lock device has a round shaft onto which a plurality of longitudinally extending rectangular recesses are provided. These recesses are so located as to correspond with the radial bores, and have a depth corresponding to the length of the pin portions of their respective lower tumblers so that the upper tumblers will be raised until their bottom ends are flush with the parting line between the barrel and the cylinder when the key is fully inserted into the keyhole in the cylinder. In this state, the turning force of the key will transmit to the pin portions of the lower tumblers, which are in contact with the side walls of the recesses, to cause the cylinder to rotate relative to the barrel, thereby locking or unlocking the lock device, when the key is further rotated.

The cylinder lock is further provided with a positioning device that indicates when the radial bores in the cylinder are aligned with the radial bores in the barrel, thus assuring the cylinder lock is in a locked state.

This invention also provides a design with regard to the configuration of the upper and lower tumblers. The upper tumbler is typically a round pin with generally planar end surfaces. The round pin may also be so formed as to have a circular larger head at its one end, or formed into a substantially solid cup configuration, as viewed perpendicularly to the upstanding tumbler, so that a conical portion extending from the intermediate portion of the pin toward one end thereof is provided.

The lower tumbler is typically a round pin having a circular larger head at its one end, and the top surface of the pin head and the bottom end surface of the pin both being rounded. The end pin portion opposite to the circular head may be formed into a cone with a rounded apex. In addition, the round pin may also be formed to have an annular flange at its intermediate portion with its extreme ends remaining rounded.

The above tumbler configuration makes the cylinder lock of this invention more pick-resistant.

DESCRIPTION OF THE PREFERRED EMBODIMENT

Figure 1:
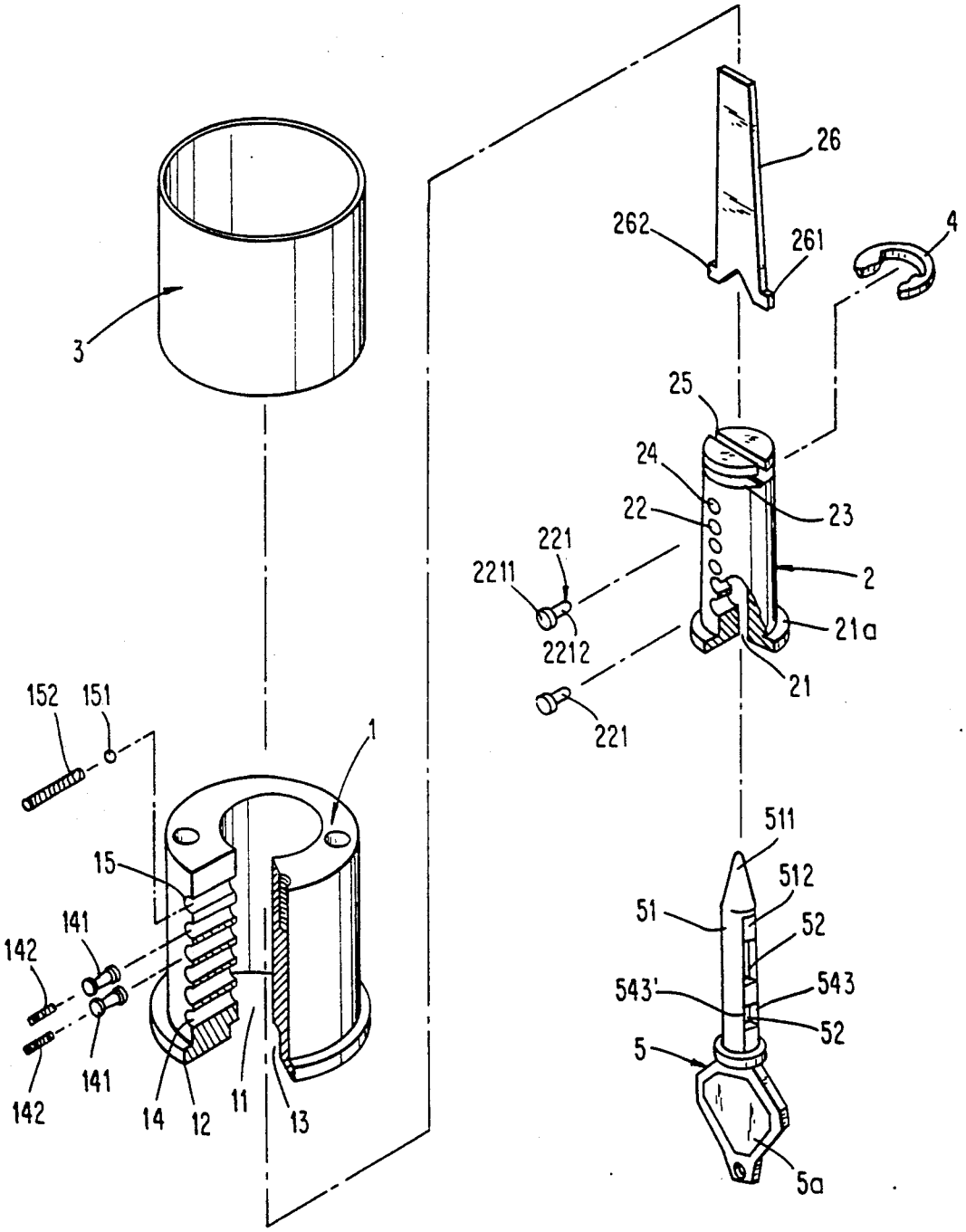
FIG. 1 is an exploded perspective view of an embodiment of this invention.
Figure 4:
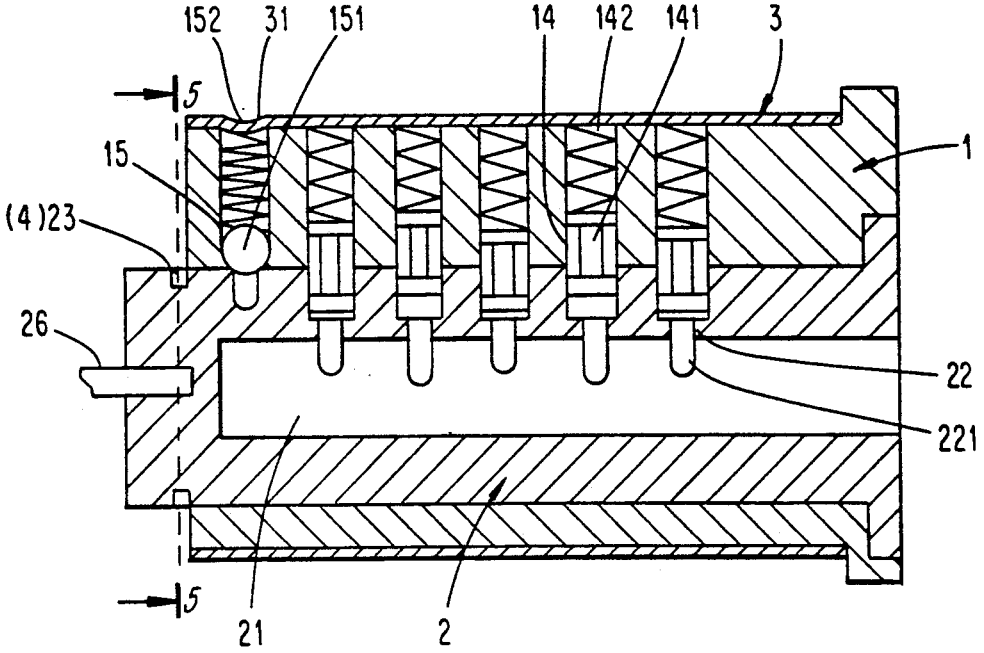
FIG. 4 is a longitudinal sectional view showing the cylinder lock of this invention in its locked state.

The drawings, particularly FIGS. 1 and 4, show a preferred embodiment of the cylinder lock of this invention.

This cylinder lock includes a cylindrical barrel 1, a cylinder 2 rotatably mounted in barrel 1, a housing 3 mounted around barrel 1, an actuating member 26 and a key 5 adapted to be inserted into cylinder 2.

Barrel 1 has a longitudinal central bore 11, an annular flange 12 formed at the front end of barrel 1, an annular recess 13 located in the inner wall at the front end of barrel 1, and a plurality of radial bores 14 formed in the wall of barrel 1 and spaced longitudinally in relation to each other. The number and spacing of radial bores 14 is to be determined as desired. In each radial bore 14, an upper tumbler 141 and a spring 142 are provided. Toward the rear end of barrel 1 and adjacent and corresponding to the last bore 14, another radial bore 15 is provided. Radial bore 15 is mounted with a ball 151 and a spring 152 to constitute a positioning device which will be described later.

Cylinder 2 has a longitudinal circular key-hole 21 for receiving round key 5. Cylinder 2 has an annular flange **21*a* formed at its front end and adapted to be received in annular recess 13, thereby allowing the front surface of flange 21*a* to be flush with the front surface of annular flange 12 when cylinder 2 is mounted in bore 11 of barrel 1. In the wall of cylinder 2, a plurality of radial stepped bores 22 are provided which correspond to radial bores 14 of barrel 1. A lower tumbler 221 is mounted in each radial bore 22 with its pin portion 2212 extending into keyhole 21 by the biasing force of spring 142. Cylinder 2 is further provided with an annular groove 23 around its rear end portion which extends beyond the rear end surface of barrel 1 when cylinder 2 is mounted therein, and a slot 25 formed in the rear end thereof and extending perpendicularly to the rear end surface of cylinder 2 to a depth beyond groove 23. Actuating member 26 having fork ends 261, 262 is detachably mounted in slot 25 by means of a snap ring 4** engaged in annular groove 23. The other end of actuating member 26 is operatively connected to a lock bolt (not shown). An indent 24 is provided on the outer wall of cylinder 2 adjacent to the last radial bore 22 to correspond with radial bore 15 of barrel 1. Indent 24 has a dimension such that ball 151 may be partly received therein when cylinder 2 is rotated to a predetermined position where its radial bores 22 are in alignment with radial bores 14, but which allowing ball 151 to escape therefrom when cylinder 2 is rotated past that predetermined position. In this way, indent 24 forms a positioning device together with ball 151 and spring 152.

Housing 3 is sleeved onto barrel 1 to maintain upper tumblers 141 and springs 142 within corresponding radial bores 14. In order to prevent housing 3 from slipping off barrel 1, an annular indent 31 (FIG. 4) in the outer wall of housing 3 may be provided by press forming at a position corresponding to radial bore 15.

Key 5 has a bow 5*a* and a round shaft 51 extending from bow 5*a*. Shaft 51 has a conical end to facilitate the insertion of key 5 into keyhole 21 of cylinder 2. Shaft 51 has its one side surface, preferably extending from bow 5*a*, flattened to form a planar surface 512 in which a plurality of recesses 52 separated by rectangular partitions of surface 512 are provided. Recesses 52 correspond respectively to lower tumblers 221 so that when key 5 is inserted into keyhole 21 and turned, lower tumblers 221 will be raised to a position in which all upper and lower tumblers 141 and 221 are so situated that there is no impediment between the barrel 1 and cylinder 2 to restrict the rotation of cylinder 2 relative to barrel 1 when key 5 is further turned.

Figure 2:
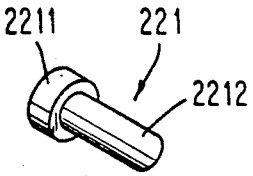
FIGS. 2, 2A, and 2B are perspective views showing various configurations of the lower tumblers of this invention.
Figure 2A:
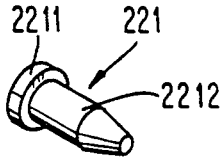
Figure 2B:
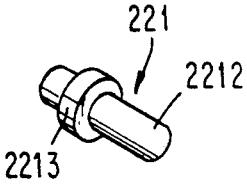
Figure 3B:
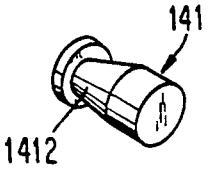
FIGS. 3, 3A, and 3B are perspective views showing various configurations of the upper tumblers of this invention.
Figure 3A:
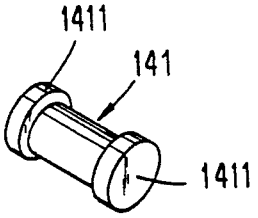
Figure 3:
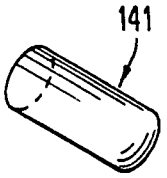
Figure 5:
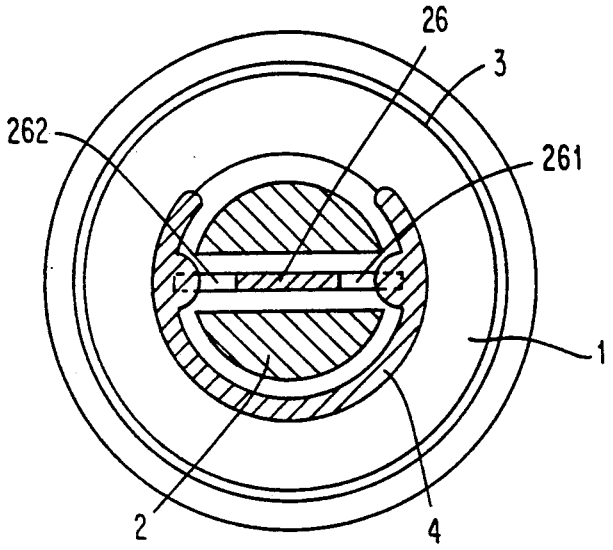
FIG. 5 is a sectional view taken along line A—A of FIG. 4.

Referring to FIG. 2, lower tumbler 221 is so configured as to have a circular head 2211 and a round pin portion 2212 extending from head 2211. The top surface of head 2211 and the end surface of pin portion 2212 are both rounded. Pin portion 2212 may have its extreme end to be formed into a conical shape, as shown in FIG. 2A. Lower tumbler 221 may also have an annular flange 2213 formed along the intermediate part of pin portion 2212, as shown in FIG. 2B. According to this invention, upper tumblers 141 may also have various configurations. For example, as shown in FIG. 3, upper tumbler 141 is formed into a round pin with planar end surfaces. Pin tumbler 141 may further be formed with a flat round head 1411 at its opposite ends, as shown in FIG. 3A. In addition, pin tumbler 41 may also be formed into a substantially solid cup-shaped configuration, as viewed perpendicularly to the elevation thereof, to have a conical portion 1412 extending between its opposite ends, as shown in FIG. 3B. These configurations help to prevent the picking of the lock.

Figure 6:
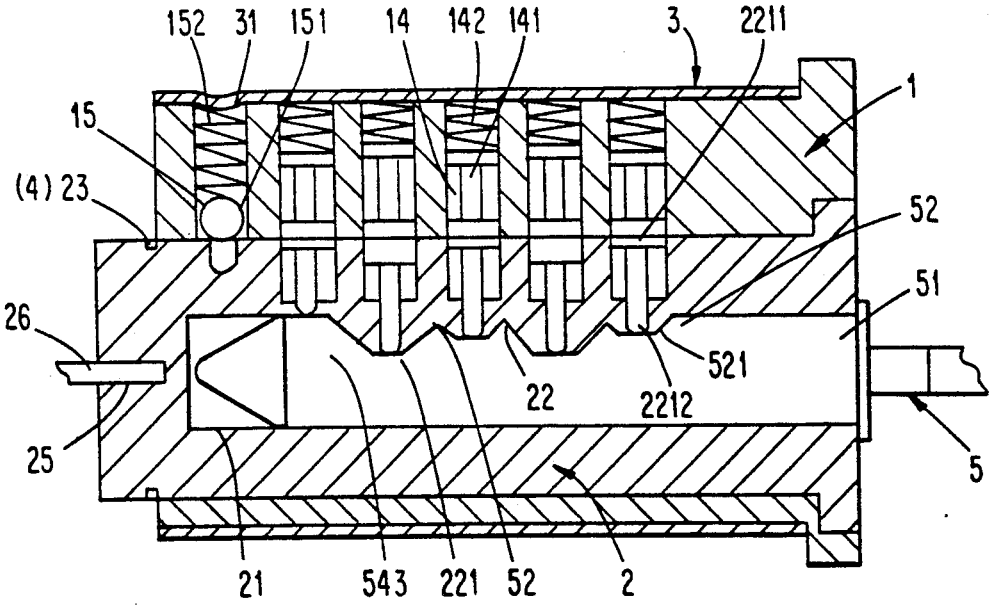
FIG. 6 is a sectional view similar to FIG. 4 with a key inserted into the cylinder lock to unlock the lock.

With the above construction, as shown in FIG. 4, the cylinder lock of this invention is normally in a locked state in which cylinder 2 is impeded from turning relative to barrel 1 as upper tumblers 141 biased by springs 142 cross the parting line between barrel 1 and cylinder 2. In this state, when a matching key 5 is fully inserted into keyhole 21 and rotated to a predetermined position, lower tumblers 221 will first be raised a predetermined amount and, pushed by the biasing force of springs 142, to cause their pin portions 2212 to move into the corresponding recesses 52, so that the lower ends of upper tumblers 141 are flush with the parting line, as shown in FIG. 6. Cylinder 2 can therefore rotate relative to barrel 1 to unlock or lock the lock device when key 5 is further rotated, as pin portions 2212 are in close contact with side walls 543 or 543' of recesses 52.

It is to be noted that, during the turning movement of key 5, each time ball 151 moving integrally with cylinder 2 comes into indent 24, a "click" sound will be produced, and a slight trembling feeling may be transmitted to the hand of the key user, both serving as an indication that cylinder 2 is being rotated to a position in which radial bores 22 are in alignment with radial bores 14.

What is claimed is:

1. A cylinder lock, comprising a barrel having a first axial bore therein, and a plurality of first radial bores formed on the peripheral wall thereof and arranged longitudinally with each other and each communicating with said first axial bore; a cylinder having a second axial bore and rotatably mounted in said first axial bore to define a parting line with said barrel, said cylinder having a plurality of second radial stepped bores each corresponding to a said first radial bore and communicating with said second axial bore; tumbler assemblies each including a spring and an upper and a lower tumblers, said springs and said upper tumblers being provided in said first radial bores, and said lower tumblers being provided in said second radial bores; and retaining means for retaining said springs and said upper tumblers in said first radial bores; wherein a key for actuating said cylinder lock has a cylindrical bar with a planar side surface, said cylindrical bar has a plurality of rectangular recesses formed on said planar surface and separated from each other by rectangular partitions, each of the rectangular recesses has top and bottom parallel walls perpendicular to a longitudinal axis of said cylindrical bar, said rectangular recesses are arranged to correspond with the pin portions of said lower tumblers such that when said key is inserted into said second axial bore and rotated to a position in which said first and second radial bores are in alignment with each other, said pin portions are received in said rectangular recesses so as to clear said parting line, whereby the turning force of said key is transmitted to said pin portions being in contact with side walls of said rectangular recesses to allow said cylinder to rotate relative to said barrel when said key is further rotated.

2. A cylinder lock of claim 1, wherein said cylinder lock further comprises a positioning means for indicating the mutual alignment of said first and second radial bores.

3. A cylinder lock of claim 2, wherein said positioning means includes a third radial bore on said barrel being adjacent and corresponding to the last one of said first radial bores; an indent on said cylinder for corresponding with said third radial bore; a ball mounted in said third radial bore and being adapted to be received partly in said indent and disengaged therefrom; and a spring mounted in said third radial bore for biasing said ball toward said cylinder.

4. A cylinder lock of claim 1, wherein an actuating member extending axially is perpendicularly attached to the rear end of said cylinder which extends beyond the rear end surface of said barrel.

5. A cylinder lock of claim 1, wherein each said upper tumbler comprises a round pin.

6. A cylinder lock of claim 1, each said tumbler comprises a round pin with circular large flanges formed on the opposite ends thereof.

7. A cylinder lock of claim 1, wherein each said upper tumbler comprises a round pin which has a substantially solid cup-shaped configuration, as viewed perpendicularly to the side elevation thereof, so that a truncated cone portion is formed between a substantially intermediate portion and one end portion thereof.

8. A cylinder lock of claim 1, wherein each said lower tumbler comprises a round pin having a circular head at its one end, the top surface of said head and the end surface of the other end of said pin are both rounded.

9. A cylinder lock of claim 8, wherein said round pin has a conical portion extending from a substantially intermediate portion to said other end of said pin.

10. A cylinder lock of claim 1, wherein each said lower tumbler comprises a round pin having round end surfaces and an annular flange formed at a substantially intermediate portion thereof.

11. A cylinder lock, comprising a barrel having an annular recess in a peripheral wall, a first axial bore, and a plurality of first radial bores formed on the peripheral wall thereof and arranged longitudinally with each other and each communicating with said first axial bore; a cylinder having a second axial bore and rotatably mounted in said first axial bore to define a parting line with said barrel, said cylinder having an annular flange adapted to be received in said annular recess, a plurality of second radial stepped bores each corresponding to a said first radial bore and communicating with said second axial bore; tumbler assemblies each including a spring and an upper and a lower tumblers, said springs and said upper tumblers being provided in said first radial bores, and said lower tumblers being provided in said second radial bores; and retaining means for retaining said springs and said upper tumblers in said first radial bores; wherein a key for actuating said cylinder lock has a cylindrical bar with a planar side surface, said cylindrical bar has a plurality of rectangular recesses formed on said planar surface and separated from each other by rectangular partitions, each of the rectangular recesses has top and bottom parallel walls perpendicular to a longitudinal axis of said cylindrical bar, said rectangular recesses are arranged to correspond with the pin portions of said lower tumblers such that when said key is inserted into said second axial bore and rotated to a position in which said first and second radial bores are in alignment with each other, said pin portions are received in said rectangular recesses so as to clear said parting line, whereby the turning force of said key is transmitted to said pin portions being in contact with side walls of said rectangular recesses to allow said cylinder to rotate relative to said barrel when said key is further rotated.

12. The cylinder lock of claim 11, wherein each of said tumblers has a flanged pin portion.

* * * * *